US008820130B2

(12) United States Patent
Delande

(10) Patent No.: US 8,820,130 B2
(45) Date of Patent: Sep. 2, 2014

(54) KEY HAVING A RETRACTABLE INSERT, AND RELATED INSERT-EXTENDING MODULE

(75) Inventor: Benoit Delande, Cedex (FR)

(73) Assignee: Valeo Securite Habitacle, Créteil (FR)

( * ) Notice: Subject to any disclaimer, the term of this patent is extended or adjusted under 35 U.S.C. 154(b) by 0 days.

(21) Appl. No.: 13/883,436

(22) PCT Filed: Nov. 4, 2011

(86) PCT No.: PCT/EP2011/069388
§ 371 (c)(1),
(2), (4) Date: Aug. 1, 2013

(87) PCT Pub. No.: WO2012/059569
PCT Pub. Date: May 10, 2012

(65) Prior Publication Data

US 2013/0298622 A1 Nov. 14, 2013

(30) Foreign Application Priority Data

Nov. 5, 2010 (FR) ..... 10 04340

(51) Int. Cl.
*A44B 15/00* (2006.01)
*E05B 19/04* (2006.01)

(52) U.S. Cl.
USPC ..... 70/456 R; 70/408

(58) Field of Classification Search
USPC ..... 70/408, 456 R, 459
See application file for complete search history.

(56) References Cited

U.S. PATENT DOCUMENTS 6,499,326 B1 * 12/2002 Heussner ..... 70/399
6,691,539 B2 * 2/2004 Jacob et al. ..... 70/408
6,705,141 B1 * 3/2004 Jacob et al. ..... 70/408
7,055,352 B2 * 6/2006 Meyerson et al. ..... 70/456 R
7,370,501 B2 * 5/2008 Miyata et al. ..... 70/395

(Continued)

FOREIGN PATENT DOCUMENTS

WO 2010/023294 A1 3/2010

OTHER PUBLICATIONS

International Search Report issued in PCT/EP2011/069388 mailed on Jan. 25, 2012 (2 pages).

*Primary Examiner* — Suzanne Barrett
(74) *Attorney, Agent, or Firm* — Osha Liang LLP

(57) ABSTRACT

The invention relates to a retractable key comprising an upper half-shell (3) and a lower half-shell which are assembled together so as to form a housing, and an insert-extending module configured so as to be mounted in said housing. The insert-extending module includes: an insert pivotably mounted in the housing between a retracted position and an deployed position, a push button (8) axially projecting from the upper half-shell (3) so as to be axially pressed by a user and comprising a rotation-locking means (9) engaging with a corresponding rotation-locking means (10) of the housing, the rotation-locking means (9, 10) guiding the push button (8) in axial translation (A-A), an elastic return element, a first end of which is attached to the insert and a second end of which is attached to the push button (8) in order to urge the insert to pivot toward the extended position when the push button (8) is pressed, and a retaining means (17) supported by the push button (8) and engaging with a complementary retaining means (18) of a half-shell of the housing, said retaining means (17, 18) being configured so as to enable the axial translation (A-A) of the push button (8).

14 Claims, 2 Drawing Sheets

Fig.2

(56) References Cited

U.S. PATENT DOCUMENTS

Figure 1:
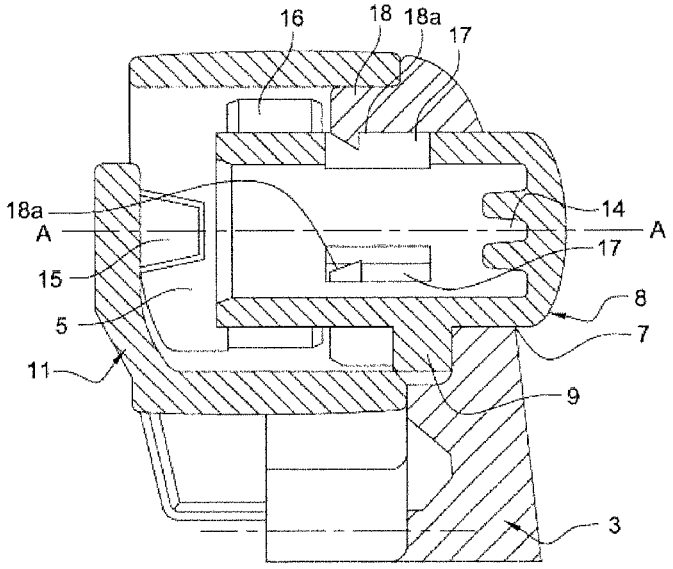

| | | | | |
|---|---|---|---|---|
| 8,225,633 | B2 * | 7/2012 | Luo et al. | 70/456 R |
| 8,266,936 | B2 * | 9/2012 | Box et al. | 70/408 |
| 8,479,546 | B2 * | 7/2013 | Delande et al. | 70/456 R |
| 2005/0103070 | A1 * | 5/2005 | Meyerson et al. | 70/456 R |
| 2007/0062229 | A1 * | 3/2007 | Miyata et al. | 70/408 |
| 2007/0220936 | A1 | 9/2007 | Miyata et al. | |
| 2009/0217722 | A1 * | 9/2009 | Luo et al. | 70/459 |

* cited by examiner

KEY HAVING A RETRACTABLE INSERT, AND RELATED INSERT-EXTENDING MODULE

The invention relates to a key having a retractable insert, in particular for a motor vehicle, comprising a casing and an insert which can be retracted inside the casing. The invention also relates to an insert deployment module designed to be mounted in the casing.

A retractable key, in particular for a motor vehicle, comprising a casing having two half-shells and an insert deployment module configured so as to be mounted in the casing is already known from WO 2010/023294.

The insert deployment module comprises an insert forming a key bit which is mounted so as to be able to pivot between a retracted position in which the insert is retracted inside the casing and a deployed position in which the insert is brought outside the casing. The insert deployment module also comprises a pushbutton which projects axially from the upper half-shell of the casing in order to be actuated by a user and an elastic return element. A first end of the elastic return element is attached to the insert in order to force it to pivot toward the deployed position when the pushbutton is actuated and a second end is attached to the pushbutton. The pushbutton also comprises a rotation prevention means which engages with a corresponding rotation prevention means of the casing, these rotation prevention means guiding the pushbutton in axial translation.

A pushbutton which is prevented from rotating makes it possible to employ a pushbutton having any shape whatsoever and makes it possible for the insert to have better flexural strength.

Furthermore, an insert deployment module which can be assembled independently of the casing with the elastic return element in a prestressed state makes it possible for it to be prefabricated and delivered by one supplier to a different manufacturer, for example one specialized in remote control devices for controlling the central locking/unlocking of the opening leaves of the vehicle.

The invention proposes an improvement to the retractable key of the prior art.

To that end, the invention relates to a retractable key comprising:

- an upper half-shell and a lower half-shell which are assembled to form a casing, and
- an insert deployment module configured to be mounted in said casing, said insert deployment module comprising:
  - an insert which is mounted in the casing so as to be able to pivot between a retracted position and a deployed position,
  - a pushbutton which projects axially from the upper half-shell in order to be depressed axially by a user and which comprises a rotation prevention means which engages with a corresponding rotation prevention means of the casing, these rotation prevention means guiding the pushbutton in axial translation, and
  - an elastic return element, a first end of which is attached to the insert and a second end of which is attached to the pushbutton in order to force the insert to pivot toward the deployed position when the pushbutton is depressed, characterized in that said insert deployment module comprises a retaining means borne by the pushbutton which engages with a complementary retaining means of one half-shell of the casing, these retaining means being configured so as to allow the pushbutton to move in axial translation.

Thus, mounting the insert deployment module inside the casing is made easier as it can be attached to one half-shell of the casing using the multiple retaining means before assembling the two half-shells, upper and lower.

Moreover, when the casing has means for removable opening and closing, the user can easily gain access to the inside of the casing, for example in order to replace a power supply means of a remote control device such as the cell or the battery, and can proceed to change this without the need for a hatch at the back of one of the half-shells of the casing and without the difficulty of repositioning the insert deployment module in the casing, it being retained on the casing by the retaining means.

Furthermore, as the retaining means is borne by the pushbutton which is itself prevented from rotating, the retaining means does not prevent the insert from pivoting into the retracted or the deployed position.

The pushbutton thus presents several means for performing various functions by the insert deployment module cooperating with the casing, inter alia for retaining the insert deployment module on the casing and for guiding the pushbutton. The number of parts forming the multiple means belonging to the insert deployment module is thus reduced.

According to one or more features, considered in isolation or in combination, of the retractable key:

- the retaining means of the pushbutton is made as a single part with the pushbutton,
- the retaining means, the rotation prevention means of the pushbutton acting as a guide in axial translation and holding projections which engage with the insert so as to lock the insert in the retracted position, are made as a single part with the pushbutton,
- the complementary retaining means of the casing is borne by the upper half-shell,
- the complementary retaining means of the casing is formed as an integral part in one internal wall of the upper half-shell,
- the retractable key comprises a remote control device housed in an internal cavity of the lower half-shell of the casing and the two half shells, upper and lower, engage by snap-fitting in order to open or close the casing in a removable manner,
- the retaining means of the pushbutton and the complementary retaining means of the casing are removable,
- the retaining means of the pushbutton and the complementary retaining means of the casing engage by snap-fitting,
- at least one snap-fitting notch is made in one side wall of the pushbutton and one internal wall of the upper half-shell has at least one complementary elastic tab the end of which has a snap-fitting tooth which is prominent toward the snap-fitting notch,
- the key comprises at least two complementary elastic tabs formed by at least two cuts created in a collar of a through-hole of the upper half-shell for the pushbutton to pass through, said cuts engaging with the rotation prevention means of the pushbutton in order guide the pushbutton axially and to prevent it from rotating.

The invention also relates to an insert deployment module for a retractable key, which module is configured to be mounted in a casing of said key, said insert deployment module comprising:

- an insert comprising a key bit support and a key bit which is securely attached to the key bit support,
- a pushbutton received in a housing of the key bit support and projecting axially from that housing from the key bit support, said pushbutton comprising a rotation prevention means designed to engage with a corresponding rotation prevention means of the casing, these rotation prevention means guiding the pushbutton in axial translation, and an elastic return element, a first end of which is attached to the key bit support and a second end of which is attached to the pushbutton, characterized in that said insert deployment module comprises a retaining means borne by the pushbutton and designed to engage with a complementary retaining means of the casing.

Figure 2:
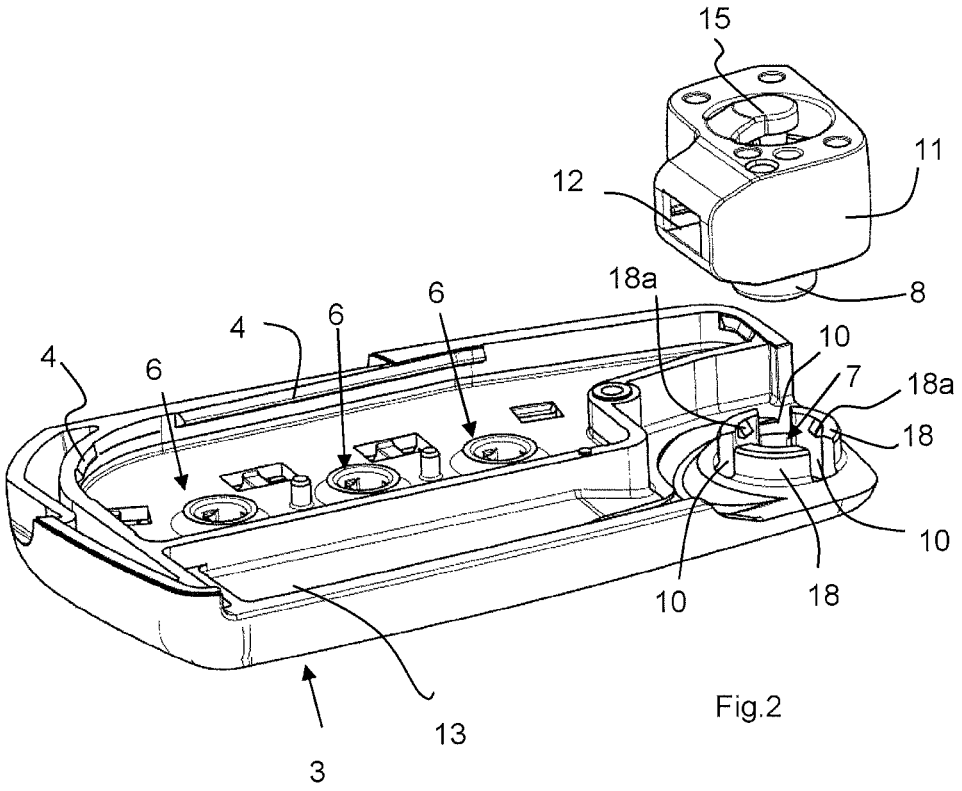
Figure 3:
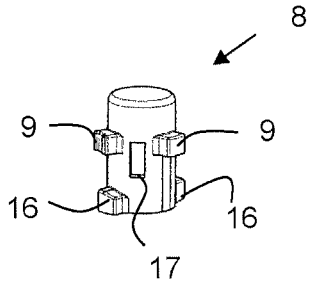
Figure 4:
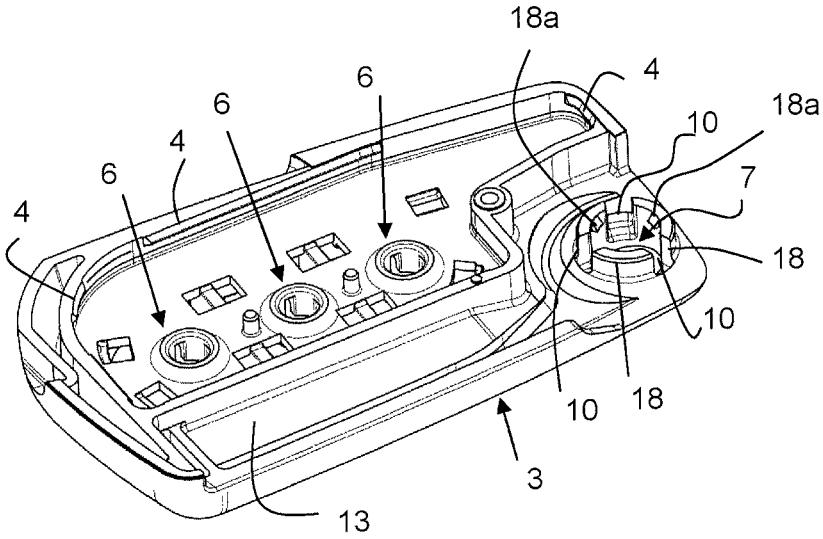

Other features and advantages of the invention will appear more clearly upon reading the following description, which is purely illustrative and entirely non-limiting, and the appended drawings, in which:

FIG. 1 shows a view in section of a detail of an upper half-shell and of elements of an insert deployment module of a retractable key in the assembled state, FIG. 2 shows a perspective view of the upper half-shell and of the elements of the insert deployment module of the retractable key of FIG. 1, the upper half-shell and the insert deployment module being in the disassembled state, FIG. 3 shows a perspective view of the pushbutton of FIG. 1, and FIG. 4 is a perspective view of an internal wall of the upper half-shell.

In the figures, identical elements bear the same reference numerals.

The retractable key, in particular for a motor vehicle, comprises an upper half-shell 3 forming a cover (FIGS. 1, 2 and 4) and a lower half-shell (not shown) forming a base. The upper half-shell 3 and the lower half-shell are assembled to form a casing for the retractable key.

The two half-shells are generally made of plastic and can be assembled, for example, by snap-fitting (or latching, that is to say by elastic deformation). For this, the upper half-shell 3 has peripheral snap-fitting edges 4, which are designed to engage by elastic deformation with a corresponding feature of the lower half-shell in the form of a snap-fitting hollow, in order to open or close the casing in a removable manner.

The lower half-shell has an internal cavity making it possible, for example, to house a remote control device (not shown). In a manner known per se, the remote control device makes it possible to control various functions of the key, in particular the central locking/unlocking of the opening leaves and the motor vehicle antitheft system or locating the motor vehicle in a parking lot.

The remote control device comprises a printed circuit board bearing the electronic circuits for the remote control of the central locking/unlocking of the opening leaves of the vehicle, a transponder for the vehicle antitheft system, and an electrical supply means consisting of a cell or a battery.

The remote control functions are actuated by the user by means of actuation means 6 provided on the upper half-shell 3 and the reverse of which can be seen in FIGS. 2 and 4. The actuation means 6 make it possible to activate switches of the printed circuit board.

The upper half-shell 3 also comprises a through-hole 7 through which a pushbutton 8 of an insert deployment module can pass. For example, the through-hole 7 is circular and the pushbutton 8 has a corresponding bell shape with a cylindrical side wall.

The pushbutton 8 projects axially (along the longitudinal axis A-A of FIG. 1) from the through-hole 7 of the upper half-shell 3 such that it can be depressed by a user and trigger the deployment of an insert from the insert deployment module.

The pushbutton 8 comprises a rotation prevention means which engages with a corresponding rotation prevention means of the casing in order to prevent the pushbutton from rotating relative to the casing when the pushbutton 8 is depressed. These rotation prevention means also guide the pushbutton 8 in axial translation along the longitudinal axis A-A of the pushbutton 8.

According to one exemplary embodiment shown in FIG. 3, the rotation prevention means of the pushbutton 8 which acts as an axial guide comprises three guiding snugs 9 which are regularly spaced at the same height on the outside of the side wall of the pushbutton 8. The guiding snugs 9 engage with three respective corresponding cuts 10 created in a collar of the through-hole 7 of the upper half-shell 3 (FIG. 2) in order to guide the axial sliding of the pushbutton 8 along the axis A-A and in order to prevent the pushbutton from rotating.

The pushbutton 8 which is prevented from rotating makes it possible to employ a pushbutton having any shape whatsoever and makes it possible for the insert to have better flexural strength.

In addition to the pushbutton 8 and the insert, the insert deployment module comprises an elastic return element (not shown).

More precisely, the insert comprises a key bit support 11 and a key bit (not shown) which is securely attached to the key bit support 11. The key bit is for example be nested at one end thereof in a complementary blind hole 12 of the key bit support 11 (FIG. 2). The key bit support 11/key bit assembly is held stationary for example by a pin.

The pushbutton 8 is received in a housing 5 of the key bit support 11 from which it projects (FIG. 1) and into which it can slide axially along the longitudinal axis A-A when it is depressed by a user.

The elastic return element has a first end which is attached to the insert, in order to force the insert to pivot toward the deployed position when the pushbutton 8 is depressed, and a second end which is attached to the pushbutton 8. The return element is for example a helical torsion spring.

The pushbutton 8 has a hollow internal space which houses the return element, the base of which has a first slot 14 preventing the second end from rotating relative to the upper half-shell 3 (FIG. 1). Furthermore, the base of the key bit support 11 can comprise a hollow peg 15 connected to a side wall of the key bit support 11 by a radial bridge which also serves as a pivot end stop for the key bit support 11. The hollow peg 15 has a second slot for attaching the first end of the elastic return element (not shown).

The insert is mounted in the casing so as to be able to pivot between a retracted position inside the casing and a deployed position projecting out from the casing. In the retracted position, the insert is for example housed in a recess 13 of one border of the casing, which is for example substantially L-shaped, corresponding to the shape of the insert. In the deployed position, the insert pivots through 180° to project out from the casing in order that the key bit can be inserted into a corresponding lock.

Furthermore, the pushbutton 8 and the key bit support 11 engage in order to hold the insert in the retracted position. To this end, the pushbutton 8 comprises at least one holding projection 16 for holding the insert in the retracted position and the key bit support 11 comprises a corresponding hole (not shown) which engages with the holding projection 16. In the retracted position, the holding projection 16 engages in the corresponding hole, prestressing the return element. When the pushbutton is depressed, the holding projection 16 is released from the corresponding hole, which makes it possible for the key bit support 11 to pivot into the deployed position. Thus, when it is depressed by a user, the pushbutton 8 releases the insert. The elastic element returns the pushbutton 8 to a position projecting from the key bit support 11 when the user releases the pushbutton.

The insert deployment module comprising the insert, the pushbutton 8 and the elastic element forms a unit which can be assembled independently of the casing with the elastic return element mounted in a prestressed state. The insert deployment module can therefore be prefabricated and delivered by one supplier to a different manufacturer, for example one specialized in remote control devices.

Once the deployment module has been assembled, it can be mounted in the casing. To this end, the insert deployment module comprises a retaining means borne by the pushbutton 8 and which engages with a complementary retaining means of an upper half-shell 3 or lower half-shell of the casing. The retaining means are moreover configured so as to allow the pushbutton 8 to move in axial translation relative to the casing.

Thus, mounting the insert deployment module inside the casing is made easier as it can be attached to one half-shell of the casing using the multiple retaining means before assembling the two half-shells, upper and lower.

Furthermore, as the retaining means is borne by the pushbutton 8 which is prevented from rotating, it does not prevent the insert from pivoting into the retracted or deployed position.

The complementary retaining means of the casing is for example borne by the upper half-shell 3 of the casing, being for example formed as an integral part in the interior surface of the upper half-shell 3.

Thus, when the retractable key comprises a remote control device housed in the internal cavity of the lower half-shell of the casing, and when the two half-shells engage by snap-fitting in order to open or close the casing in a removable manner, the user can easily gain access to the power supply means, such as the cell or the battery, and can proceed to change this means without the need for a hatch at the back of the lower half-shell and without the difficulty of repositioning the insert deployment module in the casing, it being retained on the upper half-shell 3 by the multiple retaining means.

The retaining means of the pushbutton 8 and the complementary retaining means of the casing can be removable, for example in that they engage by snap-fitting.

To this end, at least one snap-fitting notch 17 is made in one side wall of the pushbutton (FIG. 3). For example; three snap-fitting notches 17 which are regularly spaced are made at the same height in the side wall of the pushbutton 8, below the upper part of the pushbutton 8 which projects from the casing.

Moreover, one internal wall of the upper half-shell 3 has at least one complementary elastic tab 18 extending toward the snap-fitting notch and the end of which has a snap-fitting tooth 18*a* which is prominent toward the interior of the snap-fitting notch 17 (FIG. 1). The upper half-shell 3 thus has for example three complementary elastic tabs 18 which are made as an integral part of the internal wall (FIG. 4).

The complementary elastic tabs 18 engage by elastic deformation with the snap-fitting notches 17 for snap-fitting the pushbutton 8, and therefore the insert deployment module, onto the upper half-shell 3.

The teeth 18*a* of the elastic tabs 18 can move in axial translation between the two axial stops formed by the upper edges and lower edges of the snap-fitting notch 17, making it possible for the pushbutton 8 to move in axial translation relative to the casing while the pushbutton 8 is retained on the upper half-shell 3.

The elastic tabs 18 are for example formed by residual material of the upper half-shell 3 which is left between the cuts 10 made in the collar of the through-hole 7 for the purpose of axially guiding the rotation prevention means of the pushbutton 8. Thus, the ends of the residual collar portions have snap-fitting teeth 18*a* which are prominent in the direction of the center of the through-hole 7 toward the snap-fitting notches 17 of the pushbutton 8.

The retaining means, the rotation preventing means acting as a guide in axial translation and the holding projections 16 which engage with the insert in order to lock the insert in the retracted position, are for example made as a single part with the pushbutton 8. In other words, and as can be seen in FIG. 3, the pushbutton 8 which is made as a single part has a hollow internal space for housing the return element, lips 14 which are made as an integral part with the base of the pushbutton 8 in order to attach the second end of the return element, a rotation prevention means acting as a guide in axial translation for example formed by guiding snugs 9 which project from the side wall of the pushbutton 8 and a retaining means, for example consisting of notches 17 made in said side wall of the pushbutton 8.

The pushbutton 8 thus presents several means for performing various functions by the insert deployment module cooperating with the casing, inter alia for retaining the insert deployment module on the casing and for guiding the movement of the pushbutton 8. The number of parts forming the multiple means belonging to the insert deployment module is thus reduced.

The insert deployment module can then be assembled by snap-fitting onto the upper half-shell 3 by passing the pushbutton 8 through the through-hole 7 of the upper half-shell 3 and by snap-fitting the elastic tabs 18 of this half-shell into the snap-fitting notches 17 of the pushbutton 8. The lower half-shell is then snap-fitted to the upper half-shell 3 to form the casing.

Thus, when the pushbutton 8 is pressed, the return element relaxes and the key bit support 11 pivots in order to move the key bit out from its recess 13. The user can then use the key bit of the insert in the deployed position in the corresponding lock. After use, the user can fold the insert back into the retracted position in the recess 13 by pressing the pushbutton 8 so as to once again engage the holding projections 16 of the pushbutton 8 in the corresponding holes of the key bit support 11. Furthermore, access to the interior of the casing is required, for example in order to replace the power supply means, the user disassembles the upper half-shell 3 from the lower half-shell without the risk of not being able to easily reassemble the insert deployment module inside the casing as the insert deployment module remains retained on the upper half-shell 3.

The invention claimed is:

1. A retractable key comprising:

an upper halfshell and a lower halfshell which are assembled to form a casing; and an insert deployment module configured to be mounted in said casing, said insert deployment module comprising:

an insert which is mounted in the casing so as to be able to pivot between a retracted position and a deployed position, a pushbutton which projects axially from the upper half-shell in order to be depressed axially by a user and which comprises a rotation prevention means which engages with a corresponding rotation prevention means of the casing, these rotation prevention means guiding the pushbutton in axial translation, and an elastic return element, a first end of which is attached to the insert and a second end of which is attached to the pushbutton in order to force the insert to pivot toward the deployed position when the pushbutton is depressed, wherein said insert deployment module comprises a retaining means borne by the pushbutton which engages with a complementary retaining means of one halfshell of the casing, these retaining means being configured so as to allow the pushbutton to move in axial translation, and wherein the complementary retaining means retains the insert deployment module on the one halfshell of the casing when the casing is opened or disassembled.

2. The key as claimed in claim 1, wherein the retaining means of the pushbutton is made as a single part with the pushbutton.

3. The key as claimed in claim 2, wherein the pushbutton is made as a single part which comprises the retaining means, the rotation prevention means acting as a guide in axial translation, and holding projections which engage with the insert so as to lock the insert in the retracted position.

4. The key as claimed in claim 1, wherein the complementary retaining means of the casing is borne by the upper halfshell.

5. The key as claimed in claim 4, wherein the complementary retaining means of the casing is formed as an integral part in one internal wall of the upper halfshell.

6. The key as claimed in claim 4, further comprising a remote control device housed in an internal cavity of the lower halfshell of the casing and in that the two halfshells, upper and lower, engage by snapfitting in order to open or close the casing in a removable manner.

7. The key as claimed in claim 1, wherein the retaining means of the pushbutton and the complementary retaining means of the casing are removable.

8. The key as claimed in claim 7, wherein the retaining means of the pushbutton and the complementary retaining means of the casing engage by snapfitting.

9. The key as claimed in claim 8, in conjunction wherein at least one snapfitting notch is made in one side wall of the pushbutton and wherein one internal wall of the upper halfshell has at least one complementary elastic tab the end of which has a snapfitting tooth which is prominent toward the snapfitting notch.

10. The key as claimed in claim 9, further comprising at least two complementary elastic tabs formed by at least two cuts created in a collar of a throughhole of the upper halfshell for the pushbutton to pass through, said cuts engaging with the rotation prevention means of the pushbutton in order guide the pushbutton axially and to prevent the pushbutton from rotating.

11. An insert deployment module for a retractable key, which module is configured to be mounted in a casing of said key, said insert deployment module comprising:

an insert comprising a key bit support and a key bit which is securely attached to the key bit support;

a pushbutton received in a housing of the key bit support and projecting axially from that housing from the key bit support, said pushbutton comprising a rotation prevention means designed to engage with a corresponding rotation prevention means of the casing, these rotation prevention means guiding the pushbutton in axial translation, and an elastic return element, a first end of which is attached to the key bit support and a second end of which is attached to the pushbutton, wherein said insert deployment module comprises a retaining means borne by the pushbutton and designed to engage with a complementary retaining means of one halfshell of the casing, and wherein the complementary retaining means retains the insert deployment module on the one halfshell of the casing when the casing is opened or disassembled.

12. A retractable key comprising:

an upper halfshell and a lower halfshell which are assembled to form a casing, and an insert deployment module configured to be mounted in said casing, said insert deployment module comprising:

an insert which is mounted in the casing so as to be able to pivot between a retracted position and a deployed position, a pushbutton which projects axially from the upper halfshell in order to be depressed axially by a user and which comprises a rotation prevention means which engages with a corresponding rotation prevention means of the casing, these rotation prevention means guiding the pushbutton in axial translation, and an elastic return element, a first end of which is attached to the insert and a second end of which is attached to the pushbutton in order to force the insert to pivot toward the deployed position when the pushbutton is depressed, wherein said insert deployment module comprises a retaining means borne by the pushbutton which engages with a complementary retaining means of one halfshell of the casing, these retaining means being configured so as to allow the pushbutton to move in axial translation, wherein the retaining means of the pushbutton and the complementary retaining means of the casing are removable, and wherein the retaining means of the pushbutton and the complementary retaining means of the casing engage by snapfitting.

13. The key as claimed in claim 12, in conjunction wherein at least one snapfitting notch is made in one side wall of the pushbutton and wherein one internal wall of the upper halfshell has at least one complementary elastic tab the end of which has a snapfitting tooth which is prominent toward the snapfitting notch.

14. The key as claimed in claim 13, further comprising at least two complementary elastic tabs formed by at least two cuts created in a collar of a throughhole of the upper halfshell for the pushbutton to pass through, said cuts engaging with the rotation prevention means of the pushbutton in order guide the pushbutton axially and to prevent the pushbutton from rotating.

* * * * *